United States Patent [19]

Truszczinski

[11] 4,248,482

[45] Feb. 3, 1981

[54] CURVED CONVEYOR SECTION GUIDE ASSEMBLY

[75] Inventor: Helmet Truszczinski, Lunen, Fed. Rep. of Germany

[73] Assignee: Gewerkschaft Eisenhutte Westfalia, Lunen, Fed. Rep. of Germany

[21] Appl. No.: 62,913

[22] Filed: Aug. 2, 1979

[30] Foreign Application Priority Data

Aug. 12, 1978 [DE] Fed. Rep. of Germany ..... 2835391

[51] Int. Cl.[3] ..... E21C 27/34

[52] U.S. Cl. ..... 299/34; 299/43

[58] Field of Search ..... 299/32, 34, 43-45

[56] References Cited

U.S. PATENT DOCUMENTS 4,154,479 5/1979 Braun et al. ..... 299/34

FOREIGN PATENT DOCUMENTS 1207911 12/1965 Fed. Rep. of Germany ..... 299/34

1280782 10/1968 Fed. Rep. of Germany ..... 299/34

*Primary Examiner*—Ernest R. Purser

*Attorney, Agent, or Firm*—Thompson, Birch, Gauthier & Samuels

[57] ABSTRACT

A guide assembly for a curved conveyor section of a scraper-chain conveyor guides the scraper assembly from a first straight conveyor portion round the curved conveyor section to a second straight conveyor portion. This guiding is accomplished by a pair of independently rotatable pulley wheels. A further pair of independently rotatable pulley wheels are provided to guide the drive chain of a plough round the curved conveyor section. This enables the plough to be driven to and fro along the first straight conveyor portion by a drive station attached to the second straight conveyor portion adjacent to the guide assembly.

12 Claims, 2 Drawing Figures

CURVED CONVEYOR SECTION GUIDE ASSEMBLY

BACKGROUND OF THE INVENTION

This invention relates to a guide assembly for a curved conveyor section of a scraper-chain conveyor, and to a mineral mining installation incorporating such a curved conveyor section guide assembly.

A curved conveyor section is used to connect two straight portions of a scraper-chain conveyor, and in particular to connect a scraper-chain conveyor portion extending along a mineral face to a scraper-chain conveyor portion extending along a roadway or gallery. The scraper assembly of such a conveyor is guided round this curved conveyor section by a guide assembly constituted by a pair of pulley wheels which are independently rotatably mounted on a vertical axle radially inwardly of the curved conveyor section, one pulley wheel guiding the scraper assembly in the upper (conveying) run, and the other pulley wheel guiding the scraper assembly in the lower (return) run. Usually, the pulley wheels guide the scraper assembly by engagement with the radially inner ends of the scrapers (see DE-PS 2 065 424 and DE-PS 20 51 384).

In a known scraper-chain conveyor having a curved conveyor section, the drive station for the conveyor is positioned at the end of the conveyor portion extending along the roadway and adjacent to the curved conveyor section. On the other hand, the drive station for the plough (or other winning machine), which is movable to and fro along the face-side conveyor portion, is built on to that portion of the conveyor and adjacent to the curved conveyor section. Thus, the plough drive station is located wither in the restricted end zone of the mineral face, or in the roadway. In the former case, it is not possible to move the plough right up to the curved conveyor section so that a relatively large stable hole is necessary, and in the latter case, the plough drive station occupies valuable space in the roadway.

The aim of the invention is to provide a curved conveyor section guide assembly and mineral mining installation which permits a plough (or other winning machine) to win mineral right up to the curved conveyor section, and whose plough drive station is not located in the immediate and congested vicinity of the curved conveyor section.

SUMMARY OF THE INVENTION

The present invention provides a guide assembly for a curved conveyor section of a scraper-chain conveyor, the guide assembly comprising means for guiding the scraper assembly of the scraper-chain conveyor round the curved conveyor section, and means for guiding a plough drive chain round the curved conveyor section.

Advantageously, the scraper assembly guide means is constituted by a pair of co-axial independently rotatable, axially spaced rollers, and the plough drive chain guide means is constituted by a pair of co-axial, independently rotatable, axially spaced deflector rollers. Preferably, the rollers and deflector rollers are pulley wheels.

Conveniently, the deflector rollers are coaxial with the rollers, and the rollers are positioned between the deflector rollers. Preferably, the rollers and the deflector rollers are mounted in a common housing, and the deflector rollers each have a smaller diameter than the rollers.

Advantageously, the guide assembly further comprises a spreader roller for guiding the plough drive chain towards the deflector rollers the spreader roller being freely rotatable about an axis perpendicular to that of the deflector rollers.

The invention also provides a mineral mining installation comprising a scraper-chain conveyor having a first straight conveyor portion, a second straight conveyor portion and a curved conveyor section connecting the two straight conveyor portions, and a guide assembly for guiding the scraper assembly round the curved conveyor section, wherein the guide assembly is as defined above.

Preferably, the installation further comprises a plough which is movable to and fro along the first straight conveyor portion, and a plough drive station which is attached to that end of the second straight conveyor portion adjacent to the guide assembly.

Advantageously, the plough is movable to and fro along a guide which extends along the first straight conveyor portion, the guide defining two channels for accommodating the two runs of the plough drive chain.

With this installation, the plough drive station is positioned where it does not impede mining operations. Moreover, the plough itself can be moved right along the first straight conveyor portion (which extends along the face being won) and up to the guide assembly, so that mineral can be won along the entire length of the face. The provision of the deflector rollers does not lead to any appreciable increase in the size of the guide assembly (other than a slight height increase) so again there is no addition to the congestion in the area of the guide assembly.

BRIEF DESCRIPTION OF DRAWINGS

A mineral mining installation incorporating a curved conveyor section guide assembly constructed in accordance with the invention will now be described, by way of example, with reference to the accompanying drawings, in which.

DESCRIPTION OF PREFERRED EMBODIMENT

Figure 1:
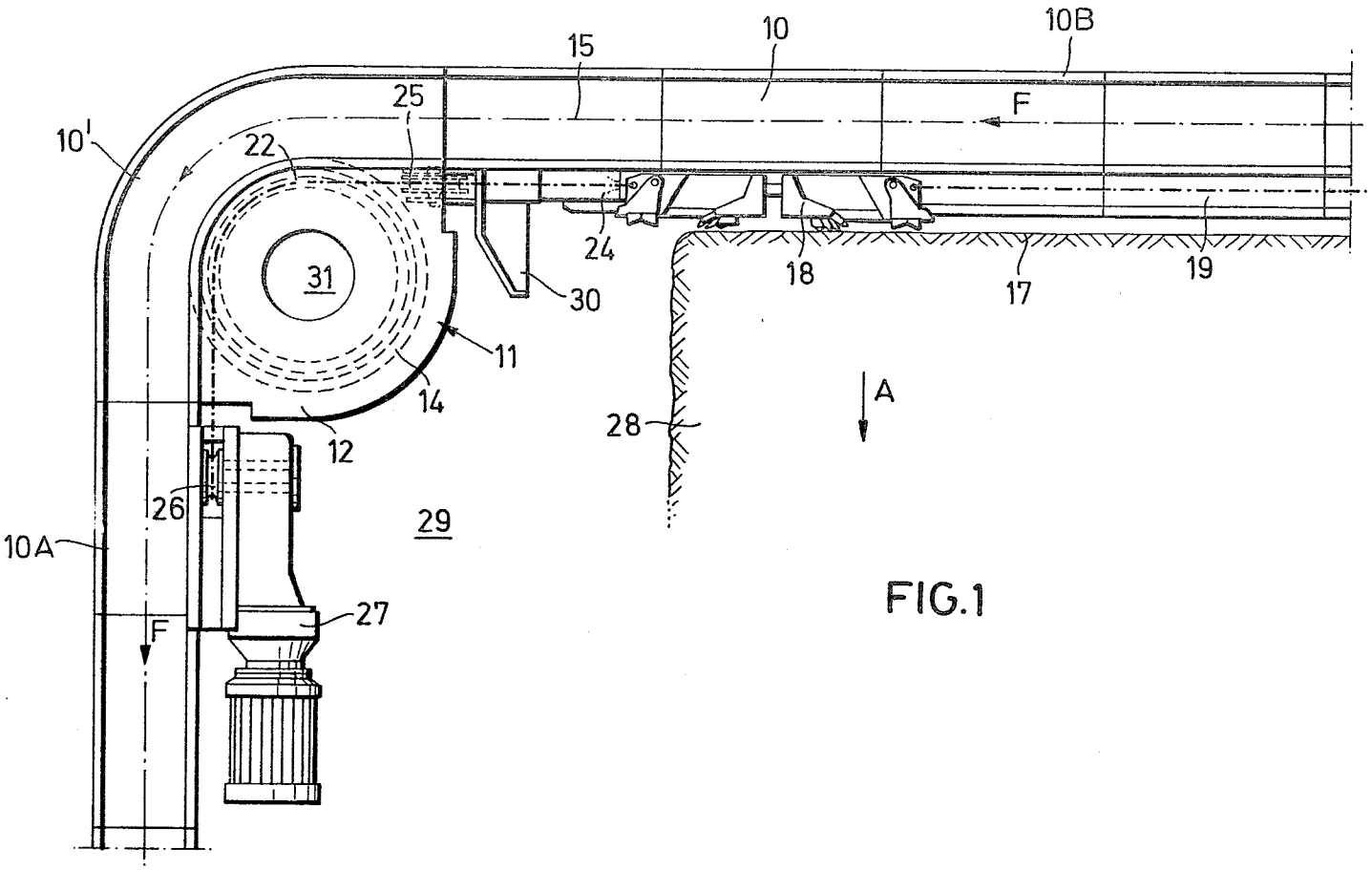
FIG. 1 is a plan view of the mineral mining installation.
Figure 2:
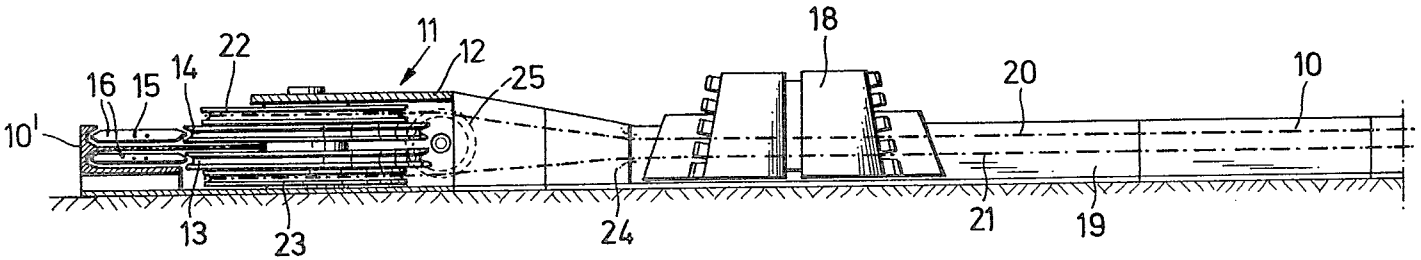
FIG. 2 is a part-sectional elevation of the mineral mining installation.

Referring to the drawings, FIG. 1 shows a scraper-chain conveyor 10 having a first, straight portion 10A joined to a second, straight portion 10B by means of a curved conveyor section 10'. The first conveyor portion 10A extends along a mine roadway or gallery 29, and the second conveyor portion extends along a mineral face 17 to be won. The scraper-chain conveyor 10 is made from individual channel sections which are joined together end-to-end so as to permit limited articulation between any given pair of channel sections. The scrapers 16 (see FIG. 2) are driven along the conveyor 10, in the direction of the arrows, by means of a central chain 15. A guide assembly 11 is provided at the inner side of the curved conveyor section 10', the guide assembly being connected to the curved conveyor section to form a single component.

The guide assembly 11 (FIG. 2) has a housing 12 containing a lower pulley wheel 13 and an upper pulley wheel 14. The pulley wheels 13 and 14 are independently rotatable about a vertical axis and are mounted on ball or roller bearings (not shown). The upper pulley wheel 14 guides the inner edges of the scrapers 16 round the curved conveyor section 10' in the upper (conveying) run, and the lower pulley wheel 13 guides the inner edges of the scrapers in the lower (return) run. The circumferential edges of the pulley wheels 13 and 14 are provided with annular grooves shaped to mate with the inner edges of the scrapers 16, and each of the pulleys has a radius corresponding to that of the inside curved portion of the curved conveyor section 10'. A drive station for the scraper chain 15 is provided at that end of the conveyor portion 10A remote from the curved conveyor section 10', this end not being shown in the drawings.

A plough 18, for winning mineral material such as coal from the face 17, is guided on a ramp-like guide 19 on the face-side of the conveyor portion 10B. The guide 19 is constituted by a plurality of guide sections joined end-to-end, and defines two enclosed channels (not shown) for the upper and lower runs 20 and 21 respectively of a plough drive chain.

The plough drive chain is driven, via a sprocket wheel 26, by means of a plough drive station 27 which is attached to the channel section of the conveyor portion 10A adjacent to the guide assembly 11. Both runs 20 and 21 of the plough drive chain are deflected round the guide assembly 11, the upper run by means of a deflector pulley 22 positioned above the pulley 14, and the lower run by means of a deflector pulley 23 positioned below the pulley 13. The deflector pulleys 22 and 23 are independently rotatable about the axis of the pulleys 13 and 14, and are mounted on ball or roller bearings (not shown). The deflector pulleys 22 and 23 are similar to the pulleys 13 and 14 but have smaller diameters. In order to adapt the distance between the upper and lower runs 20 and 21 of the plough drive chain as it emerges from the channels in the guide 19 at 24, to the vertical distance between the two deflector pulleys 22 and 23, a spreader roller 25 is fitted to the guide assembly 11. Alternatively, the spreader roller 25 could be fitted to the channel section adjacent to the guide assembly 11.

A ramp 30 is secured to the face-side of the conveyor portion 10B adjacent to the guide assembly 11, the ramp serving to guide heaped-up coal won by the plough 18 onto the conveyor. A hydraulic roof support prop 31 (see FIG. 1) is positioned on the top of the guide assembly 11.

The mineral mining installation described above is particularly useful for winning coal by the so-called "retreating system." Thus, the seam 28 shown in FIG. 1 is won by working in the direction of the arrow A, after both roadways (one only of which—roadway 29—can be seen) have been driven to the far end of the seam.

One important advantage of this installation is that the plough can be moved right up to the guide assembly 11, so that coal can be won over the entire length of the seam 28. Moreover, there is no need for a large stable hole, or for the plough drive station 27 to be situated in a congested position.

I claim:

1. A mineral mining installation comprising a scraper-chain conveyor having a first straight conveyor portion, a second straight conveyor portion, a curved conveyor section connecting the two straight conveyor portions, and a guide assembly provided with means for guiding the scraper assembly of the scraper-chain conveyor round the curved conveyor section as well as with means for guiding a plough drive chain round the curved conveyor section, wherein the scraper assembly guide means comprises scraper assembly deflection rollers, and wherein the plough drive chain guide means comprises drive chain deflection rollers, the drive chain deflection rollers being co-axial with the scraper assembly deflection rollers.

2. A guide assembly according to claim 1, wherein the scraper assembly deflection rollers are co-axial, independently rotatable, and axially spaced.

3. A guide assembly according to claim 2, wherein the scraper assembly deflection rollers are pulley wheels.

4. A guide assembly according to claim 2, wherein the drive chain deflection rollers are co-axial, independently rotatable, and axially spaced.

5. A guide assembly according to claim 4, wherein the scraper assembly deflection rollers are positioned between the drive chain deflection rollers.

6. A guide assembly according to claim 4, wherein the scraper assembly deflection rollers and the drive chain deflection rollers are mounted in a common housing.

7. A guide assembly according to claim 4, further comprising a spreader roller for guiding the plough drive chain towards the drive chain deflection rollers, the spreader roller being freely rotatable about an axis perpendicular to that of the scraper assembly deflection rollers and the drive chain deflection rollers.

8. A guide assembly according to claim 4, wherein the drive chain deflection rollers each have a smaller diameter than the scraper assembly deflection rollers.

9. A guide assembly according to claim 4, wherein the drive chain deflection rollers are pulley wheels.

10. A mineral mining installation comprising a scraper-chain conveyor having a first straight conveyor portion a second straight conveyor portion and a curved conveyor section connecting the two straight conveyor portions, and a guide assembly having both means for guiding the scraper assembly of the scraper-chain conveyor round the curved conveyor section and means for guiding a plough drive chain round the curved conveyor section, wherein the scraper assembly guide means comprises scraper assembly deflection rollers, and wherein the plough drive chain guide means comprises drive chain deflection rollers, the drive chain deflection rollers being co-axial with the scraper assembly deflection rollers.

11. A mineral mining installation according to claim 10, further comprising a plough which is movable to and fro along the first straight conveyor portion, and a plough drive station which is attached to that end of the second straight conveyor portion adjacent to the guide assembly.

12. A mineral mining installation according to claim 11, wherein the plough is movable to and fro along a guide which extends along the first straight conveyor portion, the guide defining two channels for accommodating the two runs of the plough drive chain.

* * * * *